US005152147A

United States Patent [19]

Saho et al.

[11] Patent Number: 5,152,147

[45] Date of Patent: Oct. 6, 1992

[54] GAS SWING TYPE REFRIGERATOR

[75] Inventors: Norihide Saho, Tsuchiura; Takeo Nemoto; Hisanao Ogata, both of Ibaraki; Susumu Harada; Kozo Matsumoto, both of Kudamatsu; Teruhiro Takizawa, Hitachi, all of Japan

[73] Assignee: Hitachi, Ltd., Tokyo, Japan

[21] Appl. No.: 606,725

[22] Filed: Oct. 31, 1990

[30] Foreign Application Priority Data

Nov. 1, 1989 [JP] Japan ..... 1-285229

[51] Int. Cl.[5] ..... F25B 9/00

[52] U.S. Cl. ..... 62/6; 60/520; 165/4; 165/164; 165/907; 62/467

[58] Field of Search ..... 62/467, 6; 60/520; 165/4, 10, 164, 907

[56] References Cited

U.S. PATENT DOCUMENTS

| | | | |
|---|---|---|---|
| 3,433,299 | 3/1969 | Fleming | 165/164 |
| 3,732,690 | 5/1973 | Meijer | 123/1 A |
| 3,895,675 | 7/1975 | Rein et al. | 165/164 |
| 4,359,872 | 11/1982 | Goldowsky | 165/10 |
| 4,366,680 | 1/1983 | Twaro | 62/46.1 |
| 4,405,010 | 9/1983 | Schwartz | 165/4 |
| 4,498,295 | 2/1985 | Knoos | 62/6 |
| 4,873,835 | 10/1989 | Rojey et al. | 165/907 |
| 4,939,902 | 7/1990 | Retallick | 62/46.2 |

FOREIGN PATENT DOCUMENTS

| | | |
|---|---|---|
| 123563 | 1/1984 | Japan . |
| 203267 | 6/1985 | Japan . |

*Primary Examiner*—Ronald C. Capossela

*Attorney, Agent, or Firm*—Antonelli, Terry, Stout & Kraus

[57] ABSTRACT

A refrigerator having a pressurizing device, a coldness generating device for generating coldness by expanding a portion of operating fluid which has been pressurized by the pressurizing device and a fluid passage through which the operating fluid is, via a device to be cooled, again circulated to the pressurizing device after the residual portion of the operating fluid has been cooled by the coldness generating device. A regenerator type heat exchanger is disposed in the fluid passage through which the operating fluid passes, and a switch device switches the flow of the operating fluid in the fluid passage to the reverse direction at a predetermined time period.

23 Claims, 9 Drawing Sheets

GAS SWING TYPE REFRIGERATOR

BACKGROUND OF THE INVENTION

1. Field of the Invention

The present invention relates to an extremely low temperature refrigerator, and, more particularly, to a gas swing type refrigerator capable of reducing the electric power consumption at the time of its operation.

2. Description of the Prior Art

As disclosed in Japanese Utility Model Laid-Open No. 61-203267, conventional refrigerators, for example, a helium refrigerator or a helium liquefier have been arranged to generate a desired lowest temperature and a refrigeration quantity by cooling operating fluid for use in the cooling operation from ordinary temperature by a circuit constituted by combining a coldness generator and a heat exchanger before it is expanded by a Joule-Thomson (JT) valve.

In a case where the expander is arranged to act basing upon a Gifford-Macmahon cycle, a Solvay cycle or a Stirling cycle or the like, the refrigerator is arranged in such a manner that the operating fluid, for example, helium gas, for the expander is insulated from helium gas in a JT circuit comprising a heat exchanger and a JT valve. In the JT circuit, hot and high pressure helium gas is cooled in the heat exchanger by the returned coldness and low pressure helium gas and the same is further cooled by the coldness of the expander before it is introduced into the JT valve. The heat exchanger for exchanging heat between the high pressure helium gas and the low pressure helium gas in the JT circuit usually comprises a counterflow type heat exchanger. The quantity of coldness to be generated and necessary for the expander considerably depends upon the efficiency of the above-described counterflow type heat exchanger. If the efficiency is unsatisfactory, the temperature of the high pressure helium gas at the outlet portion of the heat exchanger is excessively raised. Therefore, the heat quantity to be cooled by the expander which is disposed downstream from the heat exchanger is necessarily increased. As a result, a large quantity of coldness must be generated.

The temperature effectiveness (or the heat exchange effectiveness) of an ordinary counterflow type heat exchanger is about 0.95, which is an insufficient value.

Furthermore, since the hot and high pressure helium gas flows in a predetermined direction in the counterflow type heat exchanger, impurities such as oil, water and air and the like which have been mixed into the helium gas by the action of the compressor which serves as the source for supplying the helium gas and which is disposed in the ordinary temperature portion are undesirably accumulated in the heat exchanger.

According to the above-described conventional technology, since the counterflow type heat exchanger is employed, the obtainable temperature efficiency $\eta$ is insufficient. Therefore, the quantity of the coldness to be generated in the expander becomes necessary in proportional to $(1-\eta)$. As a result, power to operate the expander must be increased so as to obtain the necessary quantity of the coldness. Therefore, a problem arises in that the power necessary to operate the refrigerator becomes too large.

Furthermore, according to the conventional technology, another problem takes place in that the impurities contained in the gas solidify and adhere to the heat transmissive surface the temperature of which is relatively low in the heat exchanger, causing the heat effectiveness of the heat exchanger to be further deteriorated. Another problem arises in that the same stops the fluid passage so that the flow of the helium gas is obstructed. Therefore, the necessary power to operate the expander must be further enlarged. In addition, the fact that the fluid passage has been clogged causes an insufficient gas flow to take place in the JT circuit. As a result, a problem arises in that the desired lowest temperature to be reached and the quantity of refrigeration cannot be realized.

SUMMARY OF THE INVENTION

Accordingly, an object of the present invention is to provide a refrigerator, and, more particularly, a gas swing type refrigerator in which the necessary operation power can be reduced. Another object of the present invention is to provide a gas swing type refrigerator in which impurities contained in the gas cannot be accumulated in a low temperature portion of the refrigerator.

In order to achieve the above-described objects, an aspect of the present invention lies in a refrigerator having pressurization means, coldness generating means for generating coldness by expanding a portion of operating fluid which has been pressurized by the pressurization means and a fluid passage through which the operating fluid is, via means to be cooled, again circulated to the pressurization means after the residual portion of the operating fluid has been cooled by the coldness generating means. A regenerator type heat exchanger is disposed in the fluid passage through which the operating fluid passages, and switch means switch the flow of the operating fluid in the fluid passage to the reverse direction at a predetermined time period.

Another aspect of the present invention capable of achieving the above-described object lies in gas swing type refrigerator having coldness generating means for generating coldness by expanding operating fluid A which has been pressurized by first pressurization means and a fluid passage through which operating fluid B, which has been pressurized by second pressurization means, is, via means for cooling a body to be cooled, again circulated to the second pressurization means after the operating fluid B has been cooled by the coldness generating means. A regenerator type heat exchanger is disposed in the fluid passage through which the operating fluid B passes, and switch means switch the flow of the operating fluid B to the reverse direction at a predetermined time period, the switch means being disposed in the fluid passage. The above-described objects can also be achieved by a gas swing type refrigerator arranged in such a manner that a heat exchanger including a gas fluid passage through which the operating fluid B passes is disposed between the ordinary temperature portion and the coldness generating means.

Furthermore, the above-described objects can be achieved by a gas swing type refrigerator having first coldness generating means for generating coldness by expanding operating fluid A which has been pressurized by first pressurization means, second coldness generating means for generating coldness in such a manner that operating fluid B, which has been pressurized by second pressurization means, is cooled by the first coldness generating means and then the operating fluid B is expanded and a fluid passage through which the operating fluid B which has been expanded by the second coldness generating means circulates to the second pressurization means. A regenerator type heat exchanger is disposed in the gas fluid passage through which the operating fluid B passages; and gas switch is disposed in the gas fluid passage through which the operating fluid B passes and switches the gas flow of the operating fluid B to the reverse direction at a predetermined time period.

According to the above-described structure, the heat exchanger is arranged in such a manner that the regenerating material, such as copper, aluminum, phosphor bronze, rare earth metal such as lead and gadolinium and their compound is made to be a net-like shape or a granular shape before it is enclosed in a container. The thus constituted container is, at a certain period, alternately supplied with hot and high pressure helium gas and cold and high pressure helium gas so that the flowing direction is inverted for the purpose of realizing the heat exchange. The temperature effectiveness obtainable from the above-described structure can be raised to about 0.99 by making the gas switch cycle to be a proper cycle. As a result, the quantity of the coldness which must be generated by the expander can be reduced in such a manner that $(1-0.99)/(1-0.95)$=one-fifth of that obtainable from the conventional structure. As a result, the necessary power to operate the expander can be significantly reduced.

In a regenerator type heat exchanger, the hot helium gas and the cold helium gas alternately flow in the same fluid passage but in the opposite directions to each other. Therefore, the impurities mixed into the gas at the ordinary temperature portion are solidified on the surface of the regenerating material the temperature of which is at a relatively low level, the mixing of the impurities being taken place when the high temperature gas has been introduced. The oversaturated portion of the impurities thus solidified when the low temperature gas flows out is again gasified so as to be again mixed into the gas before it returns to the ordinary temperature portion. As a result, the impurities cannot accumulate in the heat exchanger. Therefore, the temperature effectiveness of the heat exchanger can be maintained and clogging by the impurities can be prevented. Consequently, the desired lowest temperature to be reached and the quantity of refrigeration in the refrigerator can be maintained for a long time.

Other and further objects, features and advantages of the invention will be appear more fully from the following description.

DETAILED DESCRIPTION OF THE PREFERRED EMBODIMENTS

Figure 1:
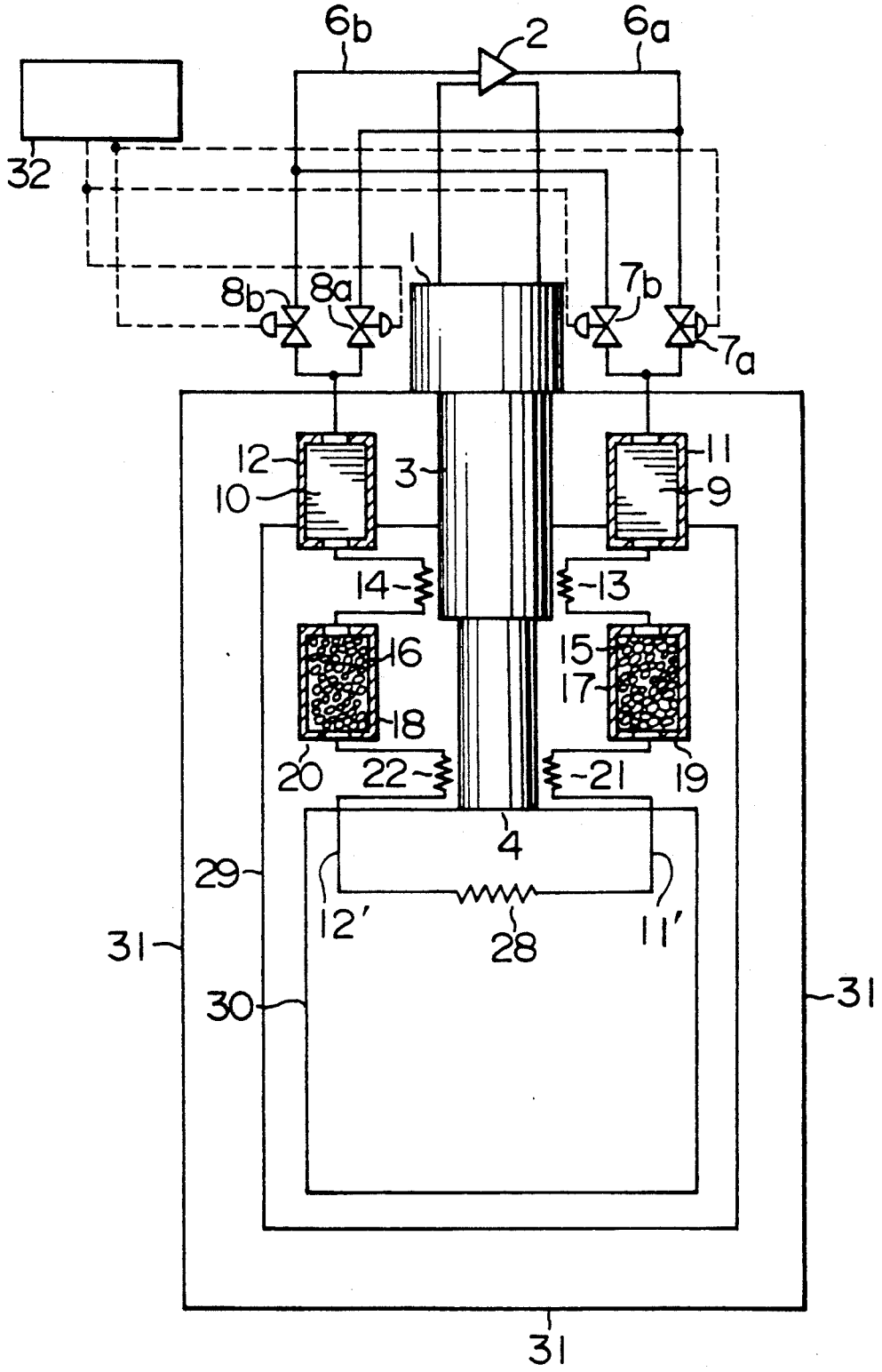
FIG. 1 is a schematic partial cross-sectional view of an embodiment of a refrigerator according to the present invention.

Referring to the drawings, preferred embodiments of the present invention will now be described.

Referring to FIG. 1, an expander 1 of a Gifford-Macmahon cycle serving as a coldness generating means receives high pressure helium gas, which is the operating fluid of ordinary temperature, from a compressor 2 serving as a pressurization means. The expander 1 then generates coldness at a first stage 3 and a second stage 4 at the corresponding temperature levels by utilizing the expansion of the helium gas. The intermediate pressure helium gas returns to the compressor 2 after it has been expanded.

On the other hand, a JT circuit comprises selector valves 7*a* and 8*a* disposed in a discharge pipe 6*a* of the compressor 2, stainless first regenerator 11 and 12 communicating with the selector valves 7*b* and 8*b* and accommodating copper nets 9 and 10, heat exchangers 13 and 14 communicating with the first regenerators 13 and 14 and connected to the first stage 3, stainless second regenerators 19 and 20 communicating with the heat exchangers 13 and 14 and including regenerating members filled with equal measures of lead grains 15 and 16 and rare earth elements: gadolinium rhodium (GdRh) grains 17 and 18. Furthermore, the JT circuit comprises a heat exchanger 28 for cooling the subject to be cooled, the heat exchanger being communicated to the second regenerators 19 and 20 via fluid passages 11' and 12'. The lower temperature portion of the refrigerator is shielded from radiation heat transmitted from room temperature vacuum chamber 31 by a first heat shield plate 29 cooled by the first stage 3 of the expander 1 and a second heat shield plate 30 cooled by the second stage 4. The operation of each of the selector valves 7*a* and 8*a* and 7*b* and 8*b*, comprising electromagnetic valves, is controlled by a controller 32 at a predetermined period T.

The expander 1 is supplied with a portion of high pressure, about 19 atm, helium gas from the compressor 2 so as to generate coldness due to an expansion. As a result, the first stage 3 is cooled to about 38 K, while the second stage is cooled to about 12 K. The intermediate pressure, about 6 atm, helium gas returns to the compressor 2 after the expansion.

The residual portion of the high pressure helium gas, which has been compressed by the compressor 2, first passes through the selector valve 7*a* in the fluid passage 11' (the selector valve 7*b* is closed at this time) before it is introduced into the first regenerator 11 at which the same is cooled by the copper net 9. Then, the helium gas is cooled to about 40 K at the first stage 3 by the heat exchanger 13 before it is introduced into the second regenerator 19 at which it is then cooled by the lead grains 15 and the GdRh grains 17. Then, the helium gas is cooled to about 13 K at the second stage 4 via the heat exchanger 21. The thus cooled high pressure helium gas absorbs heat in the heat exchanger 28 so that it is converted into low pressure helium gas before it is introduced into the heat exchanger 22. In the heat exchanger 22, the temperature of the low pressure helium gas is at a level of slightly lower than that of the second stage 4. Therefore, since the second stage 4 is not heated, the extremely low temperature of the second stage 4 can be maintained. The low pressure helium gas is introduced into the second regenerator 20 after it has flowed out from the heat exchanger 22 so as to successively cool the GdRh grains 18 and the lead grains 16 before the low pressure helium gas is introduced into the heat exchanger 14. Then, it cools the copper net 10 in the first regenerator 12 and it becomes an about 1 atm and ordinary temperature gas before it passes through the selector valve **8*b* and then it returns to the compressor 2. At this time, the selector valve 8*a*** is closed.

After predetermined time T has elapsed, the output signal from the controller 32 is switched so as to cause the selector valves **8*a* and 8*b* to be opened and the selector valves 8*a* and 7*b* to be closed so that the direction of the flow of the helium gas is inverted. The direction of helium-gas flow is switched in accordance with the action of the selector valve performed every T seconds so that a predetermined quantity of refrigeration is generated in the extremely low temperature region of the heat exchanger 28**.

Figure 2:
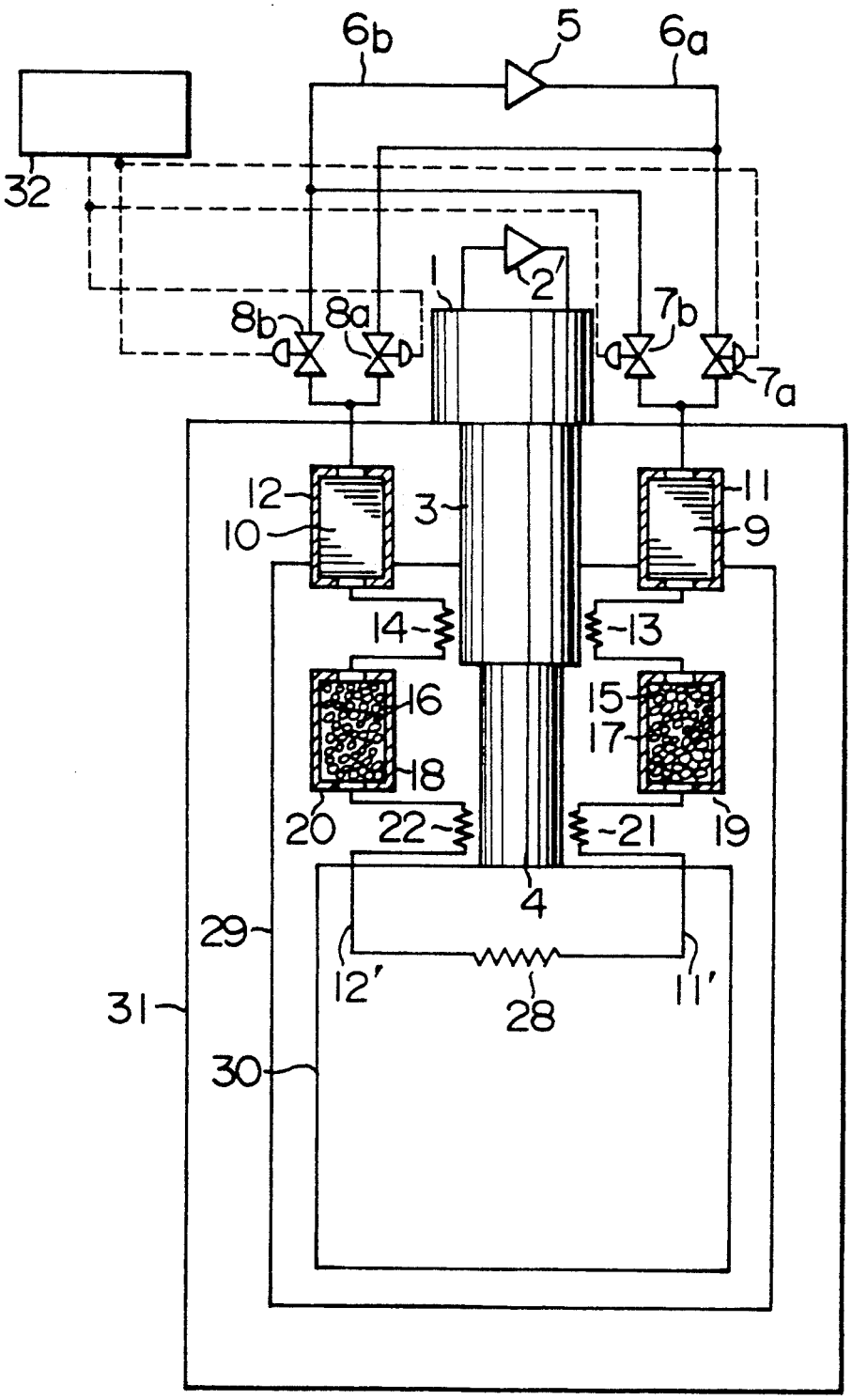
FIG. 2 is schematic partial cross-sectional view of another embodiment of the refrigerator according to the present invention.

Although the refrigerator shown in FIG. 1 has one compressor 2 as the pressurization means, the refrigerator shown in FIG. 2 has, as a first pressurization means, a compressor 2' exclusively acting for the expander 1 and another compressor 5 for cooling the subject to be cooled, the compressor 5 serving as a second pressurization means and disposed so as to be communicated to fluid passages 11' and 12'. In this case, the subject to be cooled is able to be cooled to the temperature level similar to that of the second stage 4 of the expander 1.

The thus structured refrigerator shown in FIG. 1 is very economical because only one compressor is employed. Furthermore, since the heat exchanger 28 is disposed away from the second stage 4, an effect can be obtained in that a subject to be cooled and disposed away from the heat exchanger can be efficiently cooled. This effect, in terms of the heat exchanger 28 is also obtained in the refrigerator shown in FIG. 2.

Then, another embodiment of the refrigerator according to the present invention will be described with reference to FIG. 3 wherein the same elements as those according to the refrigerators shown in FIGS. 1 and 2 are not described here but the description will be mainly made about the JT circuit.

Figure 3:
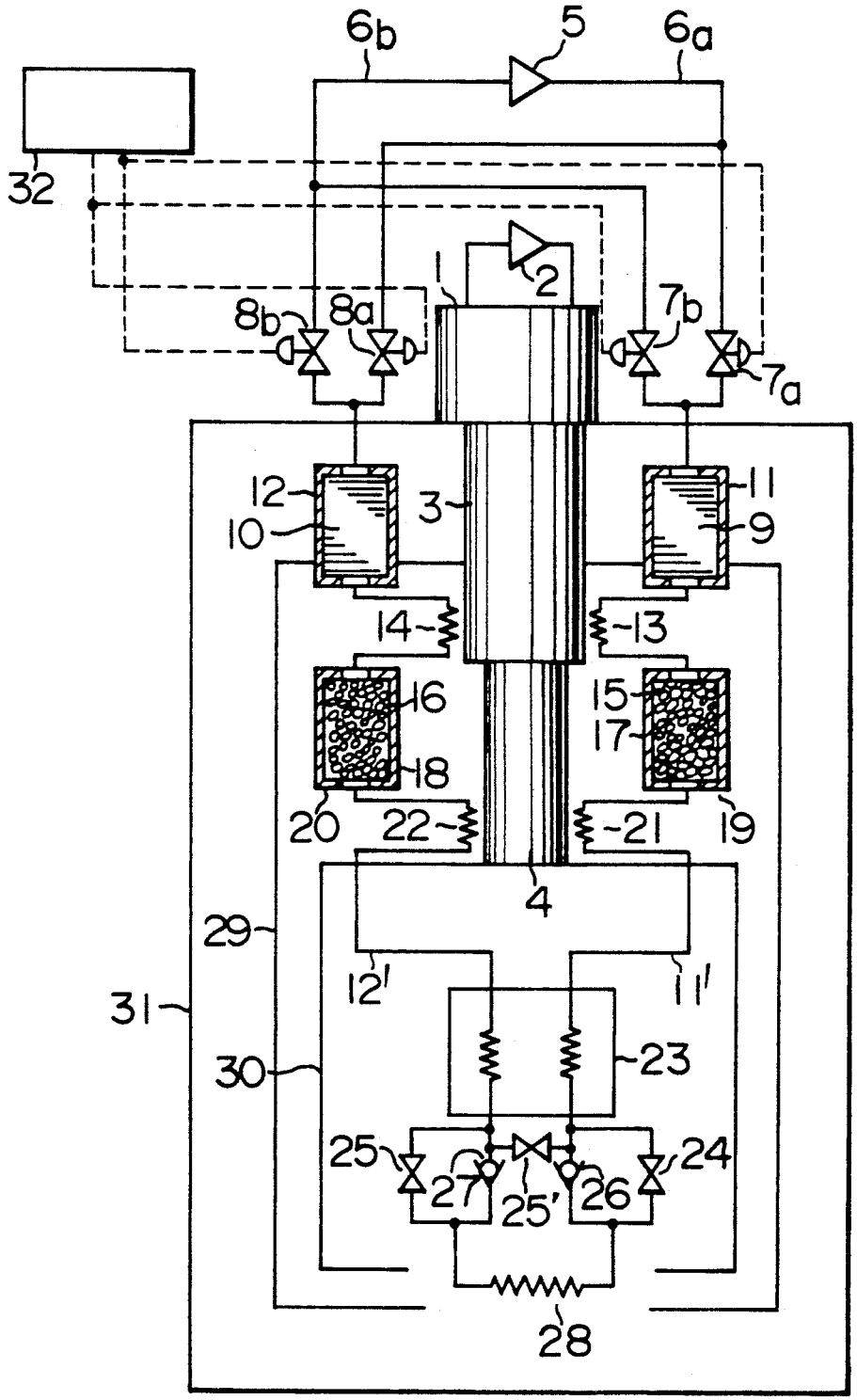
FIG. 3 is a schematic partial cross-sectional view of yet another embodiment of the present invention.

The JT circuit according to FIG. 3 is constituted by a first stage 3 comprising the first regenerators 11 and 12 and the heat expanders 13 and 14, and a second stage 4 comprising the second regenerators 15 and 16 and the heat exchangers 21 and 22, a final stage comprising a counterflow heat exchanger 23, Joule-Thomson valves 24 and 25 connected to the counterflow heat exchanger 23, check valves 26 and 27 disposed in parallel to the Joule-Thomson valves 24 and 25 and a cooling heat exchanger 28 disposed between the JT valve and the check valve. Thus, the above-described elements are established in the JT circuit according to this embodiment.

In the embodiment of FIG. 3, the helium gas is cooled to about 13 K at the second stage 4 in the JT circuit. Then, it exchanges heat in the counterflow heat exchanger 23 with the returned helium gas which has been expanded by the JT valve so that it is cooled to about 5 K in front of the JT valve 24. The helium gas is expanded at the JT valve 24 so that it becomes a gas-liquid phase the temperature of which is about 4.5 K. As a result, a quantity of refrigeration corresponding to the latent heat of vaporization of the liquid-phase helium can be obtained at the heat exchanger 28. At this time, the check valve 26 is closed in the invert flow mode. The low pressure helium gas, the temperature of which is 4.5 K, the heat of which has been absorbed by the heat exchanger 28 and the phase of which has thereby been made to be only the gaseous phase, passes through the check valve 27 showing a small resistance when fluid passes (a considerably small quantity of the helium gas pass through the JT valve in the orifice) before it cools; at the heat exchanger 23 in the fluid passage 12', the high pressure helium gas to be introduced into the JT valve 24. Then, the low pressure helium gas is introduced to the heat exchanger 22. At this time, the temperature of the low pressure helium gas is at a level slightly lower than that of the second stage 4.

Figure 6:
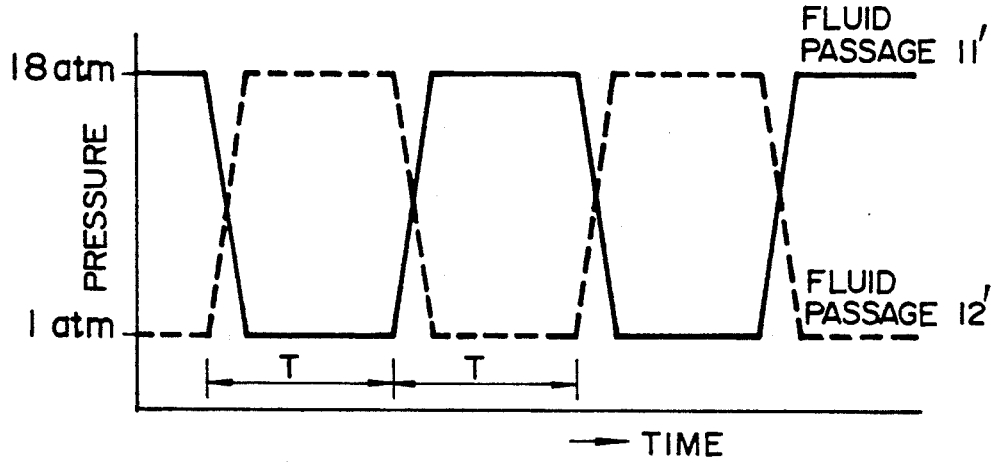
FIG. 6 is a graphical illustration of a timing of the operation of a check valve employed in the embodiments of the present invention.

In this case, the ordinary temperature high pressure helium gas is successively cooled by the first regenerator 12, the heat exchanger 14, the second regenerator 20, the heat exchanger 22, the heat exchanger 23 and the JT valve 25 in this sequential order. After the expansion by the JT valve 25, a desired quantity of refrigeration is obtained at the heat exchanger 28. Then, the helium gas passes through the check valve 26, the heat exchanger 23, the heat exchanger 21, the second refrigerator 19, the heat exchanger 13, the first regenerator 11 and the check valve **7*b* in this sequential order before it returns to the compressor 5. The change in the pressure level in the fluid passages 11' and 12' is shown in FIG. 6**.

A valve 25' is opened until the heat exchanger 23 is sufficiently cooled for the purpose of cooling the regenerator in a short time. Then, the valve 25' is closed.

The quantity of refrigeration necessary for the expander 1 is determined by the temperature efficiency of the first regenerator 11 or 12, the temperature effectiveness of the second regenerator 19 or 20 and the quantity of heat gain into the second shield plates 29 and 30. The temperature effectiveness of the regenerator has a great influence in comparison to the quantity of the heat gain into the heat shield plate.

Assuming that the mass flow of the helium gas is m (g/s), the specific heat at constant pressure of the gas is Cg (J/gK), the heat effectiveness is $\eta r$, the difference in the temperature between the hot region end the cold region end of the heat exchanger or the regenerator is $\Delta\theta$, the necessary coldness quantity $Q_{n1}$ to be generated in the first stage can be expressed by the following equation:

$$Q_{n1} = m \times C_{g1} \times (1 - \eta_{r1}) \times \Delta\theta_1$$

where subscript 1 denotes the value obtainable at the first regenerator 11 or 12. Assuming that the necessary quantity of refrigeration is about 5 W at 4.5 K, the mass flow m must be about 0.5 g/s. Since the temperature effectiveness $\eta_{r1}$ of the first refrigerators 11 and 12 can be maintained at about 0.99, $Q_{n1}$ becomes as follows assuming that the temperature difference $\Delta\theta_1=300-38=262$ K, $Cg_1=5.42$ J/gK:

$$Q_{n1} = 0.5 \times 5.42 \times (1 - 0.99) \times 262 = 7.1\ J/S\ (W)$$

The thus obtained necessary coldness quantity is 1/5 of $Q_{n1}'$ expressed as follows and obtainable from a conventional counterflow heat exchanger when the temperature effectiveness is 0.95:

$$Q_{n1}' = 0.5 \times 5.42 \times (1 - 0.95) \times 262 = 35.5\ J/S\ (W)$$

The necessary coldness quantity $Q_{n2}$ at the second stage can be expressed as follows:

$$Q_{n2}=m\cdot Cg\times(1-\eta_{r2})\times\Delta\theta_2$$

where subscript 2 denotes the value at the second regenerator 19 or 20. Since the temperature effectiveness $\theta_{r2}$ at the second regenerators 19 and 20 can be maintained at about 0.98, $Q_{n2}$ becomes as follows assuming that the temperature difference $\Delta\theta_2=38-13=25$ K, $Cg=6.05$ J/gK:

$$Q_{n2} = 0.5 \times 6.05 \times (1 - 0.98) \times 25 = 1.5\ J/S\ (W)$$

The thus obtained necessary coldness quantity is 1/5 of $Q_{n2}'$ expressed as follows and obtainable from a conventional counterflow heat exchanger when the temperature effectiveness is 0.90:

$$Q_{n2}' = 0.5 \times 6.05 \times (1 - 0.90) \times 25 = 7.5\ J/S\ (W)$$

Therefore, the necessary quantities of refrigeration for the expander 1 are 7.1 W and 1/4 W at the corresponding first and second stages to realize corresponding temperature levels 38 K and 13 K, the values being 1/5 of the conventional necessary quantities 35.5 W and 7.0 W. As a result, the power necessary to operate the expander can be reduced to 2 KW, which is 1/5 of the conventional value 10 KW. The power consumption of the controller 32 can be significantly reduced in comparison to 3 KW and 2 KW which are the power to operate the compressors 2 and 5.

As described above, according to this embodiment, the power consumption of the compressor 3 for supplying the gas to the expander 1 can be reduced to 1/5 of the conventional power consumption. Therefore, the power necessary to operate the refrigerator including the compressors 2 and 5 and the controller 32 can be reduced to about 40% of the conventional necessary power of 13 KW. As a result, the power consumption can be significantly reduced.

Since the helium gas in the JT circuit flows while swinging between the ordinary temperature and the extremely low temperature, the impurities of the ordinary temperature portion of the helium gas, for example, oil, water, $O_2$ and $N_2$ in the compressor 5 simply repeats condensation and reevaporation in each of the regenerators due to flowing of the gas. Therefore, the accumulation of the impurities can be prevented to a certain degree. As a result, the passage through which the gas flows cannot be clogged by the impurities. Furthermore, a flow pressure loss can be prevented.

According to this embodiment, although the electromagnetic valve is employed to switch the gas, a similar effect can be obtained even if a rotary valve or a sleeve valve is employed.

Figure 4:
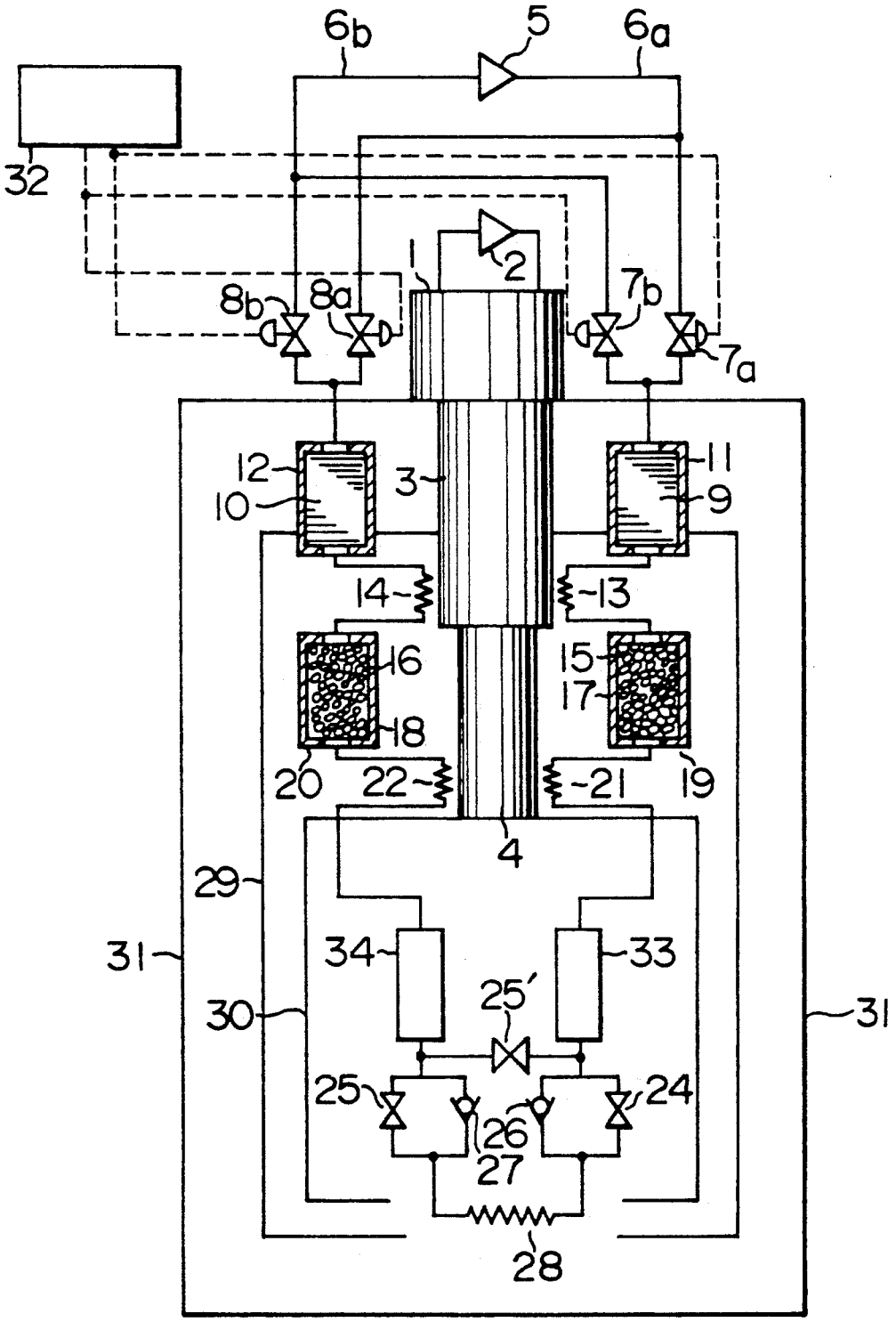
FIG. 4 is a schematic partial cross-sectional view of a still further embodiment of the present invention.

The embodiment of FIG. 4 differs from the structure shown in FIG. 3 in that the counterflow heat exchanger 23 is replaced by third regenerators 33 and 34 to each of which regenerating materials GdRh and $Gd_{0.5}Er_{0.5}Rh$ are enclosed. According to this embodiment, the temperature of the high pressure helium gas is further lowered. That is, the heat quantity $Q_{n3}$ to be driven to the front portion of the JT valve due to the temperature effectiveness of the regenerators 33 and 34 becomes as follows assuming that $\Delta\theta_3=13$ K$-5$ K$=8$ K and the average Cg between the two temperature levels is $Cg=4.93$ J/g·K since the temperature effectiveness $\eta_{r3}$ of the regenerators 33 and 34 can be maintained at 0.98:

$$Q_{n3} = 0.5 \times 4.93 \times (1 - 0.98) \times 8 = 0.39\ J/S\ (W)$$

On the other hand, since the temperature effectiveness of a counterflow heat exchanger is estimated to be about 0.95 at the above-described temperature region, the heat quantity to be driven to the portion in front of the JT valve at this time becomes as follows:

$$Q_{n3}' = 0.5 \times 4.93 \times (1 - 0.95) \times 8 = 0.99\ J/S\ (W)$$

Therefore, according to this embodiment, the loss of the heat quantity to be driven to the front portion of the JT valve can be reduced as follows: 0.99 W $-0.39$ W$=0.6$ W. As a result of this, the temperature of the helium gas in front of the JT valve can be further lowered as follows: 0.6 (J/S)+0.5 (g/s)+4.93 (J/g.K)=0.24 (K). As a result, the quantity of refrigeration of the JT expander can be further increased by about 0.3 W.

Figure 5:
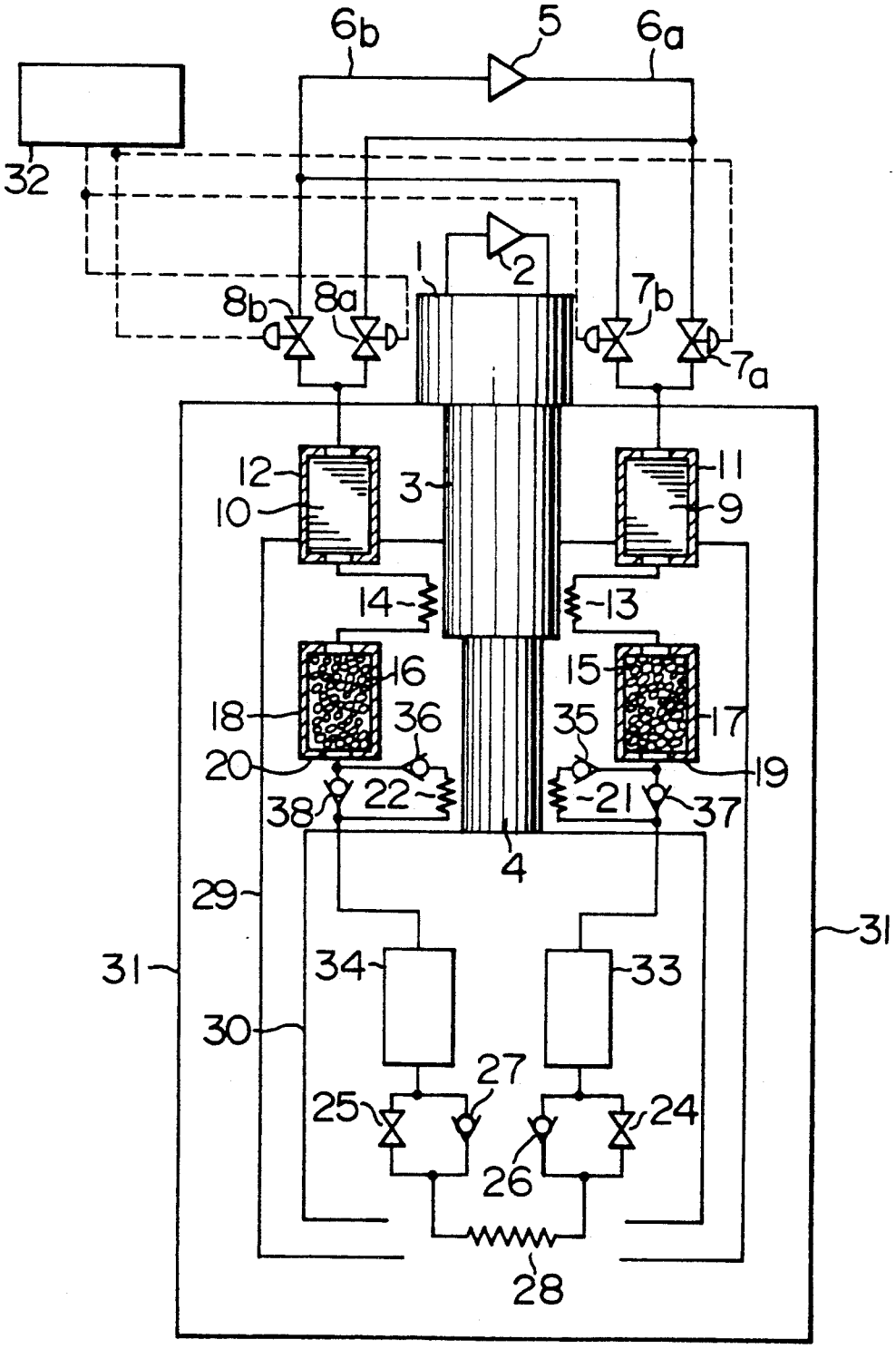
FIG. 5 is a schematic cross-sectional view of a further embodiment of a refrigeration according to the present invention.

The embodiment of FIG. 5 differs from the structure shown in FIG. 4 in that check valves 35, 36, 37 and 38 are disposed across the heat exchangers 21 and 22 fastened to the second stage 4. According to this embodiment, only high pressure helium gas is introduced into the heat exchangers 21 and 22 while preventing the introduction of the low pressure helium gas. Therefore, the flow pressure loss of the low pressure helium gas in the heat exchangers 21 and 22 can be prevented. As a result, the power necessary to operate the compressor 5 can be further reduced. If the structure according to this embodiment is applied to the portions across the heat exchangers 13 and 14, the above-described effect can be further improved.

Figure 7:
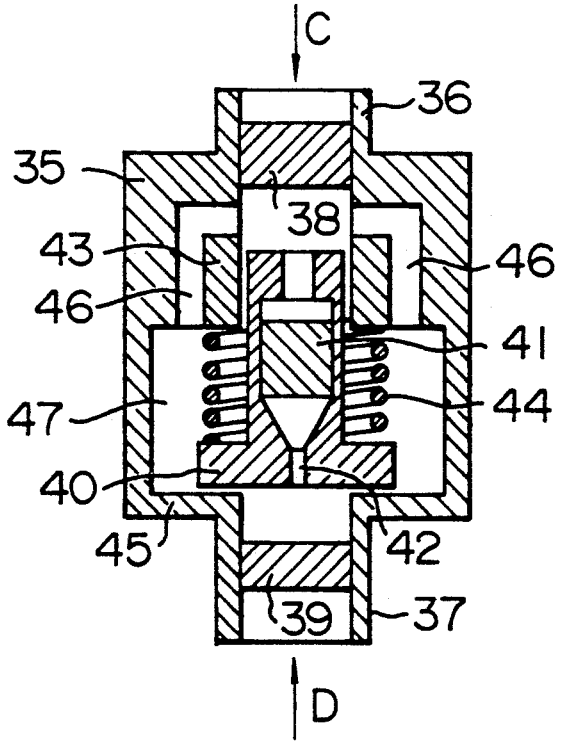
FIG. 7 is a cross-sectional view of an embodiment of an integrated-type check valve with a Joule-Thomson valve according to the present invention.

In FIG. 7 a check valve having a JT valve is provided constituted by integrating the JT valve and the check valve shown in FIG. 3. At ports 36 and 37 of the fluid passage in a housing 35, filters 38 and 39 for stopping foreign matters are disposed. A valve 40 capable of acting as the JT valve has a filter 41 and a small aperture 42, with the valve 40 being fastened to a valve seat 5 in a sleeve 43 by a coil spring 44. When operating fluid B is introduced in a direction designated by an arrow C, the fluid B, which has been introduced from a fluid passage 4b into a chamber 47, is stopped since the valve 40 and the valve seat 45 come in hermetically sealed contact with each other but it passes through the filter 41 before it is expanded by the small aperture 42 so that it generates coldness. When the direction through which the gas flows has been changed and the operating fluid B is introduced in a direction designated by an arrow D, the valve 40 floats due to the gas pressure so that a major portion of the fluid is introduced into the chamber 47 through a gap formed in the valve seat 45. The operating fluid passes through a fluid passage 46 before it flows out from the fluid port 36. According to this embodiment, since the JT valve and the check valve can be integrally formed, the piping can be simplified and the overall cost and the size of the refrigerator can thereby be reduced.

Figure 8:
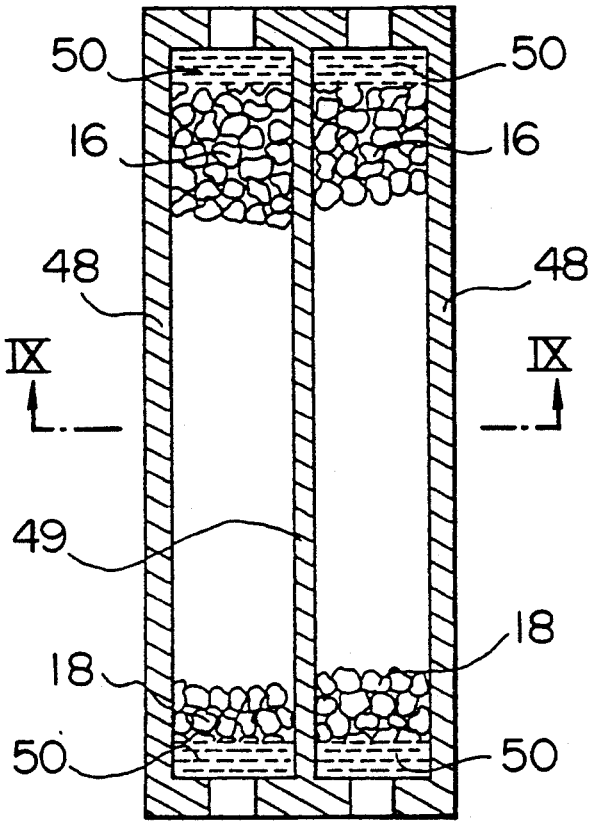
FIG. 8 is a vertical cross-sectional view of an integrated type regenerator according to the present invention.
Figure 9:
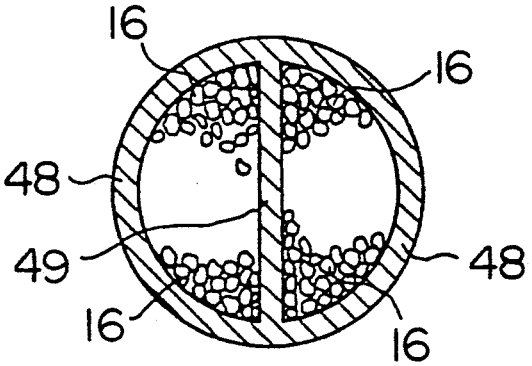
FIG. 9 is a cross-sectional view taken along the line IX—IX in FIG. 8.

The embodiment of FIGS. 8 and 9 differs from the structure shown in FIG. 3 in that the second regenerators 19 and 20 are integrated. An outer vessel 48 is sectioned into two chambers which are air-tightly isolated from each other by a partition wall 49. Filters 50 comprising copper nets or the like are fitted to the ports of the regenerators 18 and 19 through which the gas is introduced/discharged so that the regenerating material is retained there.

According to this embodiment, since the two regenerators is integrated, both the overall size of the regenerator and the external surface can be reduced. Therefore, the undesirable introduction of external radiation heat can be reduced and the temperature efficiency can further be improved. In addition, since heat of the fluids passing through the two regenerators can be exchanged to each other via the partition wall 49, an effect of the counterflow heat exchanger can be obtained, causing the temperature efficiency to be improved. According to this embodiment, the partition wall 49 is made of a flat plate, the integrated regenerator may be made of a concentrical double shell cylinder, causing the similar effect to be obtained.

Figure 10:
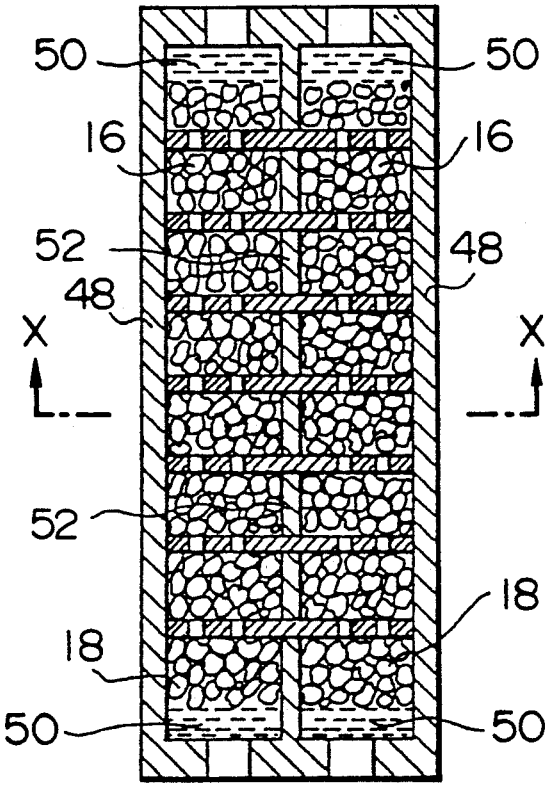
FIG. 10 is a vertical cross-sectional view of another embodiment of an integrated type regenerator according to the present invention.
Figure 11:
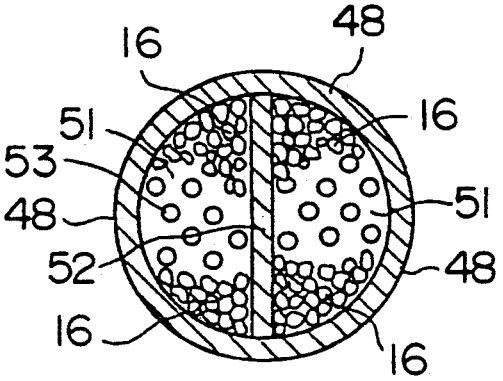
FIG. 11 is a cross-sectional view taken along the line XI—XI in FIG. 10.
Figure 12:
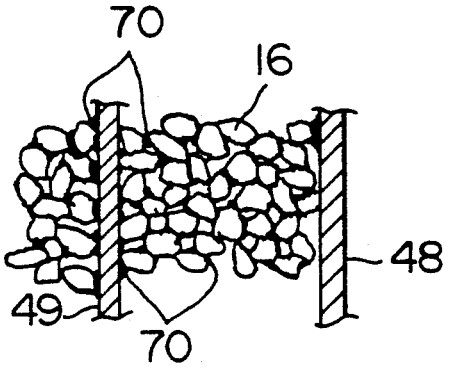
FIG. 12 is a partial vertical cross-sectional view of yet another embodiment of an integrated type regenerator according to the present invention.

The embodiment of FIGS. 10 and 11 differ from the structures shown in FIGS. 8 and 9 in that a copper porous plate 51 is arranged between two fluid passages which are respectively filled with regenerating materials 16. Furthermore, the portion between the two fluid passages is sectioned into two chambers by a partition wall 52. The partition wall 52 and the porous plate 51, the partition wall 52 and the outer vessel 48 are integrally formed by soldering or an adhesive agent in such a manner that they are sealed up.

According to this embodiment, the fluid flows through the aperture 53 of the porous plate 51, the heat of the two fluids are exchanged to each other via the porous plate 51. As a result, a counterflow heat exchanger exhibiting a large heat transmissive area can be constituted so that the temperature effectiveness can be significantly improved. In the case where the regenerating material is composed of the GdRh, the specific temperature of the regenerator is insufficient when the temperature of the regenerator is higher than 20 K in the state of precooling the refrigerator. As a result, the effect obtainable from the regenerator is unsatisfactory. In such a case, a significantly improved effect can be obtained in the above-described temperature region from a structure in which heat is exchanged via a porous plate. Therefore, the temperature effectiveness can be improved over the entire temperature region.

Although the copper porous plate is employed according to the above-made description, it can be omitted from the structure if the regenerating materials 16 are thermally coupled to each other in a state in which the helium gas is able to pass through and are respectively coupled to the partition walls 49 and 52 since the heat of the two fluid passages can be exchanged to each other. That is, the contact portions 70 of the regenerating materials 16 are coupled to each other in a metallurgy manner by diffusional coupling or the like so that the regenerating materials serves a fin which is operated as a heat exchanger acting on the fluid passing through the two fluid passages across the partition wall 49. As a result, the temperature efficiency can be further improved.

Figure 13:
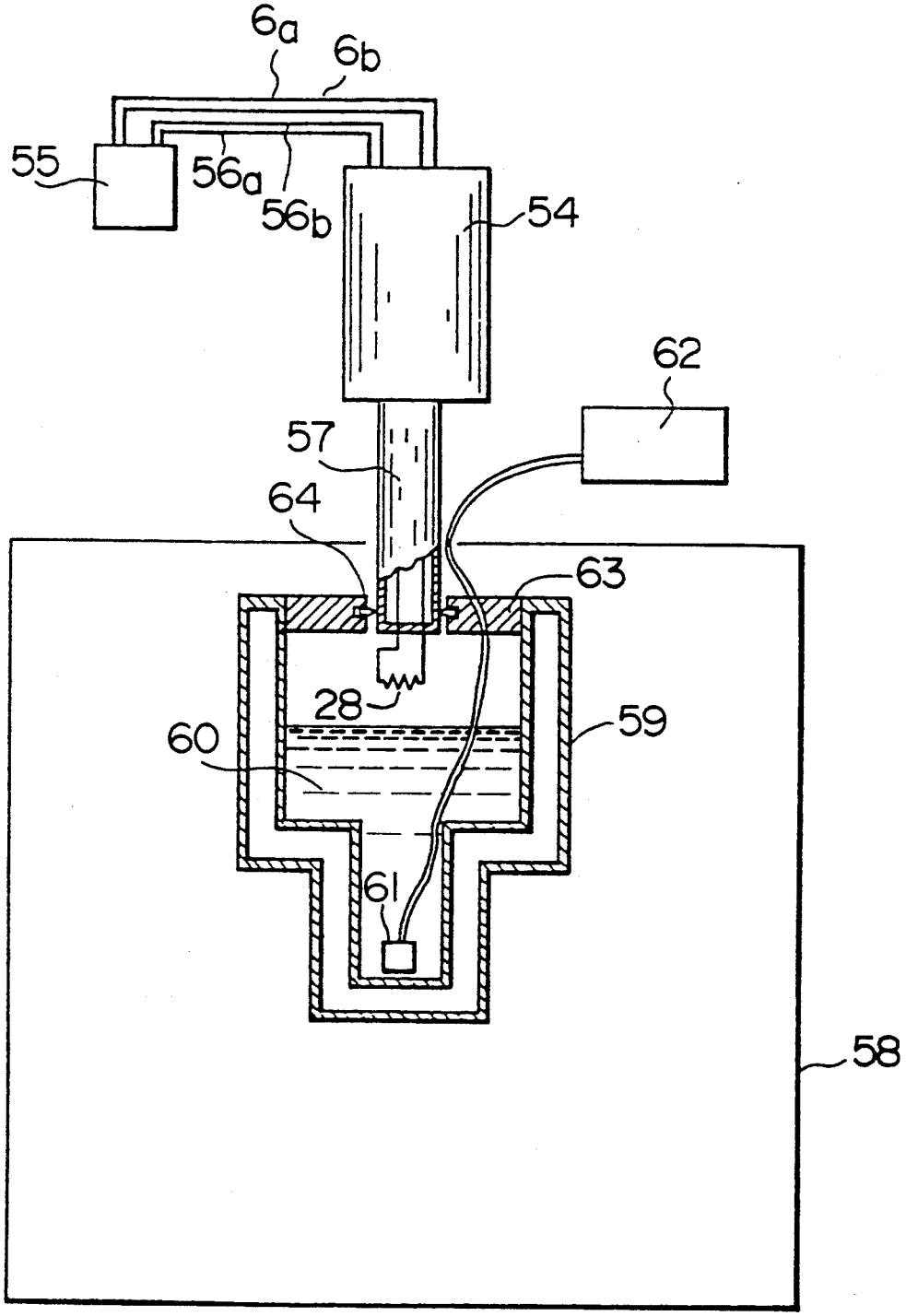
FIG. 13 is a partial cross-sectional schematic view of an example of an application of the present invention.

The embodiment of FIG. 13 differs from the structure shown in FIG. 3 lies in that a cooling heat exchanger 28 is separated from a main body 54 of the refrigerator. The operating fluid is supplied to the expander disposed in the main body 54 from the compressor unit 55 through pipings 56a and 56b. The cooling heat exchanger 28 passes through an adiabatic piping 57 and a magnetic shield box 58, with the cooling heat exchanger 28 being communicated with a gaseous phase portion of fluid helium 60 in an adiabatic container 59. A magnetic sensor 61 is disposed in the lower portion of the fluid helium in such a manner that its output is detected by a measuring portion 62. The inner portion of the adiabatic container 59 is sealed by a cover 63 and an "O" ring 64. The evaporated gas of the fluid helium is again condensed by the cooling heat exchanger 28 so that the necessary of its supply can be eliminated for a long time.

According to this embodiment, the cooling heat exchanger 28 having no movable portion and the main body 54 having movable portions and thereby generating magnetic noise can be spaced away from each other. Therefore, an effect can be obtained in that a cooling structure revealing very small noise generation can be realized. If the adiabatic piping 57 is arranged to be a bellows structure, another effect can be obtained in that the vibration can be prevented.

Although the description has been made about the refrigerator according to the present invention, if heating is necessary in addition to the structure according to the present invention, the expander can be arranged to serve as a heater. Therefore, the present invention can be applied so as to act as a gas swing type heater by arranging the expansion cycle to serve as a compression cycle or an equipped heater is operated.

According to the present invention, the heat exchanger of the Joule-Thomson circuit of the refrigerator can be constituted by the regenerator. Therefore, the heat exchange efficiency in the heat exchanger can be improved and the quantity of refrigeration of the expander in the refrigerator can thereby be reduced. As a result, the necessary power to operate the expander can be reduced to 1/5. Thus, an effect can be improved in that the power consumption of a refrigerator can be significantly reduced. Furthermore, since high and low temperature gas flows can alternately be inverted, impurities repeats condensations and vaporizations so that the accumulation of the impurities can be prevented. Therefore, the refrigerator can stably be operated for a long time.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A refrigerator comprising pressurization means for pressurizing an operating fluid, coldness generating means for generating coldness by expanding a portion of the operating fluid and for cooling a remaining portion of said operating fluid, a fluid passage through which said operating fluid is circulated to said pressurization means after the remaining portion of said operating fluid has been cooled by said coldness generating means, means for cooling a body in the fluid passage, a regenerator type heat exchanger disposed in said fluid passage through which said operating fluid passes, and switch means for switching said operating fluid in said fluid passage in a reverse direction after a predetermined time period.

2. A refrigerator according to claim 1, wherein said regenerator type heat exchanger is disposed at an ordinary temperature portion of the fluid passage in which said operating fluid has not yet been cooled.

3. A refrigerator according to claim 1, wherein said fluid passage includes cooling portions being cooled by said coldness generating means and a pair of regenerator type heat exchangers symmetrically disposed with respect to said means for cooling a body.

4. A refrigerator according to claim 3, wherein said pair of regenerator type heat exchangers symmetrically disposed in said fluid passage are counterflow heat exchangers in which regenerating materials are enclosed in the fluid passage thereof.

5. A swing type refrigerator including coldness generating means for generating coldness by expanding a first operating fluid and cooling a second operating fluid, first pressurization means for pressurizing the first operating fluid, a fluid passage for passing the second operating fluid, second pressurization means for pressurizing the second operating fluid circulated to said second pressurization means by said fluid passage after said second operating fluid has been cooled by said coldness generating means, means for cooling a body in said fluid passage, a regenerator type heat exchanger disposed in said fluid passage through which said second operating fluid passes, and switch means disposed in said fluid passage for switching the flow of said second operating fluid in a reverse direction at a predetermined time period.

6. A gas swing type refrigerator including coldness generating means for generating a coldness by expanding a first operating fluid and cooling a second operating fluid, first pressurization means for pressurizing the first operating fluid, second pressurization means for pressurizing a second operating fluid, a fluid passage for circulating said second operating fluid to said second pressurization means after said second operating fluid has been cooled by said coldness generating means, means for cooling a body in said fluid passage, switch means for switching the flow of said second operating fluid to a reverse direction after a predetermined time period, said switch means being disposed in said fluid passage through which said second operating fluid passes, and a heat exchanger having, therein, a gas fluid passage for conducting said second operating fluid, said heat exchanger being disposed between an ordinary temperature portion of said fluid passage and said coldness generating means.

7. A gas swing type refrigerator having coldness generating means for generating coldness by expanding a first operating fluid and cooling a second operating fluid, first pressurization means for pressurizing said first operating fluid, second pressurization means for pressurizing a second operating fluid, means for cooling a body, a fluid passage means for circulating said second operating fluid to said second pressurization means after said second operating fluid has been cooled by said coldness generating means, means for cooling a body in said fluid passage, gas switch means disposed in said fluid passage for switching a flow of said second operating fluid to a reverse direction after a predetermined time period, and a regenerator disposed between an ordinary temperature portion of said fluid passage and said coldness generating means, said regenerator having a regenerating material spaced within said gas fluid passage.

8. A gas swing type refrigerator including a coldness generating means for generating a coldness by expanding a first operating fluid and cooling a second operating fluid, first pressurization means for pressurizing the first operating fluid, second pressurization means for pressurizing a second operating fluid, means for cooling a body, a fluid passage for circulating said second operating fluid to said second pressurization means after said second operating fluid has been cooled by said coldness generating means, a regenerator type heat exchanger disposed in said fluid passage for conducting said second operating fluid, gas switch means for switching flow of a gas of said second operating fluid to a reverse direction after a predetermined time period, and a check valve disposed in said fluid passage adjacent to said coldness generating means, said check valve conducting said gas of said second operating fluid to flow on a side adjacent to said coldness generating means when said gas of said second operating fluid has been expanded.

9. A gas swing type refrigerator including a coldness generating means for generating coldness by expanding a first operating fluid and cooling a second operating fluid, first pressurization means for pressurizing said first operating fluid, second pressurization means for pressurizing said second operating fluid, means for cooling a body, a fluid passage for circulating said second operating fluid to said second pressurization means after said second operating fluid has been cooled by said coldness generating means, a regenerator type heat exchanger disposed in said gas fluid passage for conducting said second operating fluid, gas switch means for switching a flow of a gas of said second operating fluid to a reverse direction after a predetermined time period, and a check valve disposed in said fluid passage adjacent to said coldness generating means, said check valve conducting said gas of said second operating fluid to flow on a side adjacent to said coldness generating means when said gas of said second operating fluid has been expanded, wherein said check valve includes a Joule-Thomson valve for generating said coldness.

10. A gas swing type refrigerator including coldness generating means for generating a coldness by expanding a first operating fluid and cooling a second operating fluid, first pressurization means for pressurizing the first operating fluid, second pressurization means for pressurizing a second operating fluid, means for cooling a body, a fluid passage for circulating said second operating fluid to said second pressurization means after said second operating fluid has been cooled by said coldness generating means, gas switch means disposed in said fluid passage for conducting said second operating fluid and switching a flow of gas of said second operating fluid to a reverse direction at a predetermined time period, and a counterflow type heat exchanger disposed between an ordinary temperature portion of said fluid passage and said coldness generating means and disposed in said fluid passage through which said second operating fluid is conducted, and wherein said counterflow heat exchanger includes a regenerator disposed in said fluid passage and said regenerator enclosing a regenerating material.

11. A gas swing type refrigerator including first coldness generating means for generating coldness by expanding a first operating fluid and cooling a second operating fluid, first pressurization means for pressurizing the first operating fluid, second coldness generating means for generating additional coldness so that said second operating fluid is expanded, second pressurization means for pressurizing said second operating fluid, cooled by said first coldness generating means, a fluid passage circulating second operating fluid to said second pressurization means, a regenerator type heat exchanger disposed in said fluid passage for conducting said second operating fluid, and gas switch means disposed in said fluid passage for conducting said second operating fluid and switching a flow of a gas of said second operating fluid to a reverse direction after a predetermined time period.

12. A gas swing type refrigerator including first coldness generating means for generating coldness by expanding a first operating fluid and cooling a second operating fluid, first pressurization means for pressurizing said first operating fluid, second coldness generating means for generating additional coldness for expanding said second operating fluid second pressurization means for pressurizing said second operating fluid, a fluid passage connected to said second coldness generating means for circulating said second operating fluid to said second pressurization means, gas switch means disposed in said fluid passage for switching a flow of a gas of said second operating fluid to a reverse direction after a predetermined time period, and a heat exchanger disposed in said fluid passage for conducting said second operating fluid, said heat exchanger being disposed in said fluid passage at a position between one of an ordinary temperature portion of said fluid passage and said first coldness generating means or between said first coldness generating means and said second coldness generating means.

13. A gas swing type refrigerator including first coldness generating means for generating coldness by expanding a first operating fluid and cooling a second operating fluid, first pressurization means for pressurizing said first operating fluid, second coldness generating means for generating additional coldness by expanding said second operating fluid, second pressurization means for pressurizing said second operating fluid, a fluid passage for circulating said second operating fluid to said second pressurization means, gas switch means disposed in said fluid passage for switching a flow of a gas of said second operating fluid to a reverse direction after a predetermined time period, and a regenerator disposed ins aid fluid passage at a position between one of an ordinary temperature portion of said fluid passage and said first coldness generating means or between said first coldness generating means and said second coldness generating means, said regenerator having a gas fluid passage filled with a regenerating material.

14. A gas swing type refrigerator including first coldness generating means for generating coldness by expanding a first operating fluid and cooling a second operating fluid, first pressurization means for pressurizing said first operating fluid, second coldness generating means for generating additional coldness and expanding said second operating fluid, second pressurization means for pressurizing said second operating fluid, a fluid passage for circulating said second operating fluid to said second pressurization means, a regenerator type heat exchanger disposed in said fluid passage for conducting said second operating fluid, gas switch means disposed in said fluid passage for switching a flow of a gas of said second operating fluid to a reverse direction after a predetermined time period, and a check valve disposed in said fluid passage adjacent to said second coldness generating means, said check valve conducting said gas of said second operating fluid to flow on a side adjacent to said second coldness generating means when said gas of said second operating fluid has been expanded.

15. A gas swing type refrigerator including first coldness generating means for generating coldness by expanding a first operating fluid and cooling a second operating fluid, first pressurization means for pressurizing said first operating fluid, second coldness generating means for generating additional coldness and expanding said second operating fluid, second pressurization means for pressurizing said second operating fluid, a fluid passage for circulating said second operating fluid to said second pressurization means, a regenerator type heat exchanger disposed in said fluid passage, gas switch means disposed in said fluid passage for switching a flow of a gas of said second operating fluid to a reverse direction after a predetermined time period, and a check valve disposed in said fluid passage adjacent to said second coldness generating means, said check valve conducting said gas of said second operating fluid to flow along a side adjacent to said second coldness generating means when said gas of said second operating fluid has been expanded, wherein said check valve includes a Joule-Thomson valve for generating further coldness.

16. A gas swing type refrigerator including first coldness generating means for generating coldness by expanding a first operating fluid and cooling a second operating fluid, first pressurization means for pressurizing said first operating fluid, second coldness generating means for generating additional coldness and expanding said second operating fluid, second pressurization means for pressurizing said second operating fluid, a fluid passage for circulating said second operating fluid to said second pressurization means, gas switch means disposed in said fluid passage for switching a flow of a gas of said second operating fluid to a reverse direction after a predetermined time period, a counterflow type heat exchanger disposed ins aid fluid passage at a position between one of an ordinary temperature portion of said fluid passage and said first coldness generating means or between said first coldness generating means and said second coldness generating means, said counterflow type heat exchanger being disposed in said fluid passage for conducting said second operating fluid, and a regenerator disposed in said fluid passage within aid counterflow type heat exchanger, said regenerator being filled with a regenerating material.

17. A gas swing type refrigerator including first coldness generating means for generating coldness by expanding a first operating fluid and cooling a second operating fluid, first pressurization means for pressurizing said first operating fluid, second coldness generating means for generating additional coldness and expanding said second operating fluid, second pressurization means for pressurizing said second operating fluid, a fluid passage for circulating said second operating fluid to said second pressurization means, gas switch means disposed in said fluid passage for switching a flow of a gas of said second operating fluid to a reverse direction after a predetermined time period, a regenerator disposed in said fluid passage at a position between said first coldness generating means and said second coldness generating means, said regenerator being disposed in said fluid passage and being filled with a regenerating material, and a bypass valve disposed between said regenerator and said second coldness generating means.

18. A gas swing type refrigerator including coldness generating means for generating coldness by expanding a first operating fluid and cooling a second operating fluid, first pressurization means for pressurizing said first operating fluid, a fluid passage for circulating said second operating fluid, second pressurization means for pressurizing said second operating fluid, means for cooling a body, a regenerator type heat exchanger disposed in said fluid passage, switch means for switching a flow of a gas of said second operating fluid to a reverse direction after a predetermined time period, said switch means being disposed in said fluid passage, and said means for cooling said body being disposed in a gaseous phase portion of said fluid passage, said second operating fluid being helium and disposed in a sealed adiabatic container in a magnetic shield box.

19. A refrigerator according to claim 18, wherein said check valve includes a Joule-Thomson valve comprising a housing having ports for communicating with a piping at two end portions thereof, a valve body having small apertures through which fluid, which has been introduced into either of said communicating ports, passes and arranged to close said communicating port when said valve body is, by a spring, forcibly brought into contact with a valve seat which forms the other communicating port; and a bypass fluid passage for introducing said fluid, which has been reversely flowed into said housing through a gas between said valve body and said valve seat which has been formed by the pressure of said fluid flowing against the urging force of said spring.

20. A refrigerator according to any of claim 1, 5 or 18, wherein said regenerator includes a plurality of fluid passage, said portion being filled with a regenerating material and conducts said second operating fluid.

21. A refrigerator according to any of claim 1, 5 or 18, wherein said regenerator includes a plurality of fluid passages for conducting said second operating fluid, each of the fluid passages is filled with a regenerating material and are hermetically insulated from each other by a partition wall.

22. A refrigerator according to any of claim 1, 5 or 18, wherein said regenerator includes a plurality of fluid passages for conducting said second operating fluid, each of the fluid passages is filled with a regenerating material and each of the fluid passages is hermetically insulated from each other by a partition wall, wherein copper porous plates are layered between said plurality of fluid passages.

23. A refrigerator according to any of claim 1, 5 or 18, wherein said regenerator includes a plurality of fluid passages for conducting said second operating fluid, each of said fluid passages is filled with regenerating materials and is hermetically insulated from another of the fluid passages by a partition wall, and wherein copper porous plates are layered between said plurality of fluid passages and said regenerating materials are coupled to said partition wall while conducting said operating fluid, said regenerating materials being coupled such that heat can be transmitted to said partition wall.

* * * * *